US009631637B2

(12) United States Patent
Sassanelli et al.

(10) Patent No.: US 9,631,637 B2
(45) Date of Patent: Apr. 25, 2017

(54) COMPRESSOR END HEAD HEATING ARRANGEMENT

(76) Inventors: Giusepe Sassanelli, Florence (IT); Manuele Bigi, Calenzano (FR); Suresh Devanbu, Bangalore Karnataka (IN)

( * ) Notice: Subject to any disclaimer, the term of this patent is extended or adjusted under 35 U.S.C. 154(b) by 1298 days.

(21) Appl. No.: 13/514,388

(22) PCT Filed: Dec. 3, 2010

(86) PCT No.: PCT/EP2010/068845

§ 371 (c)(1),
(2), (4) Date: Nov. 20, 2012

(87) PCT Pub. No.: WO2011/069909

PCT Pub. Date: Jun. 16, 2011

(65) Prior Publication Data

US 2013/0058769 A1 Mar. 7, 2013

(30) Foreign Application Priority Data

Dec. 7, 2009 (IT) ..... 2009A00061

(51) Int. Cl.
*F04D 29/58* (2006.01)
*F04D 29/12* (2006.01)
(Continued)

(52) U.S. Cl.
CPC ..... *F04D 29/584* (2013.01); *F04D 17/125* (2013.01); *F04D 29/124* (2013.01); *F04D 29/624* (2013.01)

(58) Field of Classification Search
CPC ..... F04D 29/08; F04D 29/083; F04D 29/10; F04D 29/104; F04D 29/12; F04D 29/124;
(Continued)

(56) References Cited

U.S. PATENT DOCUMENTS 2,223,519 A * 12/1940 Hornschuch ..... F16J 15/183 277/515
4,872,689 A * 10/1989 Drumm ..... F16J 15/162 165/179
(Continued)

FOREIGN PATENT DOCUMENTS

EP 0781948 A1 7/1997
EP 2048367 A1 4/2007
(Continued)

OTHER PUBLICATIONS

Unofficial English translation of Notice of Allowance issued in connection with corresponding RU Application No. 2012124946 on Feb. 18, 2015.
(Continued)

*Primary Examiner* — Gregory Anderson
*Assistant Examiner* — Alexander White
(74) *Attorney, Agent, or Firm* — GE Global Patent Operation

(57) ABSTRACT

A compressor end head for providing a thermal barrier near a mechanical seal includes an inner end head and an outer end head. The outer end head includes an opening in the center for enclosing the inner end head, an outlet and grooves alongside surfaces radially adjacent the opening. The inner end head has an opening in the center, an inlet, grooves in the opening for enclosing an end portion of a compressor shaft and a flow path along an outer surface.

12 Claims, 10 Drawing Sheets

(51) Int. Cl.
*F04D 29/62* (2006.01)
*F04D 17/12* (2006.01)

(58) Field of Classification Search
CPC .. F04D 29/584; F04D 29/5853; F04D 29/588; F04D 29/624; F04D 17/125; F01D 11/003; F05D 2240/55; F16J 15/162; F16J 15/26; F16J 15/28; F16J 15/34; F16J 15/3404; F16J 15/3408; F16J 15/3412; F16J 15/3416; F16J 15/342; F16J 15/38; F16J 15/443; F16J 15/4472; F16J 15/4476
See application file for complete search history.

(56) References Cited

U.S. PATENT DOCUMENTS

| | | | | |
|---|---|---|---|---|
| 5,516,121 | A | 5/1996 | Bolusset et al. | |
| 5,718,560 | A | 2/1998 | Lorenzen | |
| 6,132,168 | A * | 10/2000 | Kovaleski | F01D 11/001 415/107 |
| 2007/0102139 | A1 * | 5/2007 | Puggioni | F04D 29/124 165/72 |
| 2010/0322765 | A1 * | 12/2010 | Markwalder | F04D 17/125 415/230 |

FOREIGN PATENT DOCUMENTS

| | | | |
|---|---|---|---|
| RU | 2202713 | C2 | 4/2003 |
| RU | 2006112002 | A | 10/2007 |
| SU | 542844 | A1 | 1/1977 |
| WO | 2005026589 | A1 | 3/2005 |

OTHER PUBLICATIONS

Unofficial English Translation of Chinese Office Action and Search Report issued in connection with corresponding CN Application No. 201080063295.7 on Aug. 11, 2014.

Unofficial English Translation of Japanese Office Action issued in connection with corresponding JP Application No. 2012-542469 on Oct. 21, 2014.

International Search Report and Written Opinion dated Feb. 28, 2011 which was issued in connection with the Italian Application No. CO2009A000061 which was filed on Dec. 7, 2009 and for the PCT Application No. EP10/068845 which was filed on Dec. 3, 2010.

Unofficial English translation of Notice of Allowance issued in connection with corresponding Kazakhstan KZ Application No. 201211566.1 on Dec. 6, 2013.

* cited by examiner

COMPRESSOR END HEAD HEATING ARRANGEMENT

CROSS REFERENCE TO RELATED APPLICATIONS

This is a national stage application under 35 U.S.C. §371(c) of prior-filed, co-pending PCT patent application serial number PCT/EP2010/068845, filed on Dec. 3, 2010, which claims priority to Italian Patent Application No. CO2009A000061, filed on Dec. 7, 2009, the entire contents of which are incorporated herein by reference.

BACKGROUND OF THE INVENTION

Field of the Invention

Exemplary embodiments relate generally to compressors and, more specifically, to the provision of thermal barriers for ensuring the smooth operation of a compressor over a wide temperature range.

Description of the Prior Art

A compressor is a machine which increases the pressure of a compressible fluid, e.g., a gas, through the use of mechanical energy. Compressors are used in a number of different applications and in a large number of industrial processes, including power generation, natural gas liquification and other processes. Among the various types of compressors used in such processes and process plants are the so-called centrifugal compressors, in which the mechanical energy operates on gas input to the compressor by way of centrifugal acceleration, for example, by rotating a centrifugal impeller.

Centrifugal compressors can be fitted with a single impeller, i.e., a single stage configuration, or with a plurality of impellers in series, in which case they are frequently referred to as multistage compressors. Each of the stages of a centrifugal compressor typically includes an inlet conduit for gas to be compressed, an impeller which is capable of providing kinetic energy to the input gas and a diffuser which converts the kinetic energy of the gas leaving the impeller into pressure energy.

A multistage compressor 100 is illustrated in FIG. 1. Compressor 100 includes a shaft 120 and a plurality of impellers 130. The shaft 120 and impellers 130 are included in a rotor assembly that is supported through bearings 190 and 190' and sealed to the outside through sealings 180 and 180'.

The multistage centrifugal compressor 100 operates to take an input process gas from an inlet duct 160, to increase the process gas pressure through operation of the rotor assembly, and to subsequently expel the process gas through an outlet duct 170 at an output pressure which is higher than its input pressure. The process gas may, for example, be any one of carbon dioxide, hydrogen sulfide, butane, methane, ethane, propane, liquefied natural gas, or a combination thereof. Between the impellers 130 and the bearings 190 and 190', the sealings 180 and 180' are provided to prevent the process gas from flowing through to the bearings 190, 190'.

Each of the impellers 130 increases the pressure of the process gas. Each of the impellers 130 may be considered to be one stage of the multistage compressor 100. Additional stages, therefore, result in an increase in the ratio of output pressure to input pressure.

Compressors in oil and gas industries and power plants are operated with different gas temperatures. The temperature varies from cryogenic to very high temperature. The internal surfaces in boiled off gas application (BOG) compressors are subjected to cryogenic temperature while the outer surfaces of the compressor are exposed to atmospheric temperature. Due to the cryogenic temperature, thermal contraction occurs in the components. The contraction is not uniform due to variation in temperature on different parts. The non-uniform contraction reduces clearance and/or creates interference between the adjacent components and affects performance of the compressors. In BOG compressors, the differential thermal contraction between the sealings 180 and 180' (in general, mechanical seals or dry gas seal type or DGS), the end head 140 and 140' (which could also include heated seal carrier), the bearings 190 and 190' and the shaft 120 creates interference between them and affects normal operation of the compressor.

In order to remove or reduce thermal tension across the operating temperatures involved, dry gas seals 180 and 180' are encapsulated in heated seal carriers 140 and 140' that also act as thermal shields.

It would be desirable to minimize thermal tension and stress on the dry gas seal and the end head by introducing a thermal barrier around the DGS to ensure smooth operation of the BOG compressor.

BRIEF SUMMARY OF THE INVENTION

Systems and methods according to these exemplary embodiments provide radial and axial thermal barriers to minimize thermal tension and stress on a mechanical seal and an end head by introducing a thermal barrier around the mechanical seal to ensure smooth operation of the BOG compressor.

According to an exemplary embodiment, a compressor end head for providing a thermal barrier near a mechanical seal includes an inner end head and an outer end head. The outer end head includes an opening in the center for enclosing the inner end head, an outlet and grooves along side surfaces radially adjacent the opening. The inner head has an opening in the center, an inlet, grooves in the opening for enclosing an end portion of a compressor shaft and a flow path along an outer surface.

According to another exemplary embodiment, a compressor end head for providing a thermal barrier near a mechanical seal includes an inner end head and an outer end head. The inner head includes an opening in the center, an inlet, grooves in the opening for enclosing an end portion of a compressor shaft. The outer end head includes an opening in a center for enclosing the inner end head, an outlet, grooves along side surfaces radially adjacent the opening, an inlet chamber connected to the inlet, an outlet chamber connected to the outlet and axial channels connecting the inlet chamber and the outlet chamber.

According to a further embodiment, a compressor includes a shaft, a plurality of impellers, a plurality of seals, an inner end head and an outer end head adjacent the seals. The outer end head includes an opening in the center for enclosing the inner end head, an outlet and grooves along side surfaces radially adjacent the opening. The inner head has an opening in the center, an inlet, grooves in the opening for enclosing an end portion of a compressor shaft and a flow path along an outer surface.

BRIEF DESCRIPTION OF THE DRAWINGS

The accompanying drawings illustrate exemplary embodiments, wherein.

DETAILED DESCRIPTION OF THE INVENTION

The following detailed description of the exemplary embodiments refers to the accompanying drawings. The same reference numbers in different drawings identify the same or similar elements. Also, the following detailed description does not limit the invention. Instead, the scope of the invention is defined by the appended claims.

In exemplary embodiments, interference between a mechanical seal and an end head is prevented by providing axial thermal barriers around the mechanical seal to ensure smooth operation of a BOG compressor.

Figure 1:
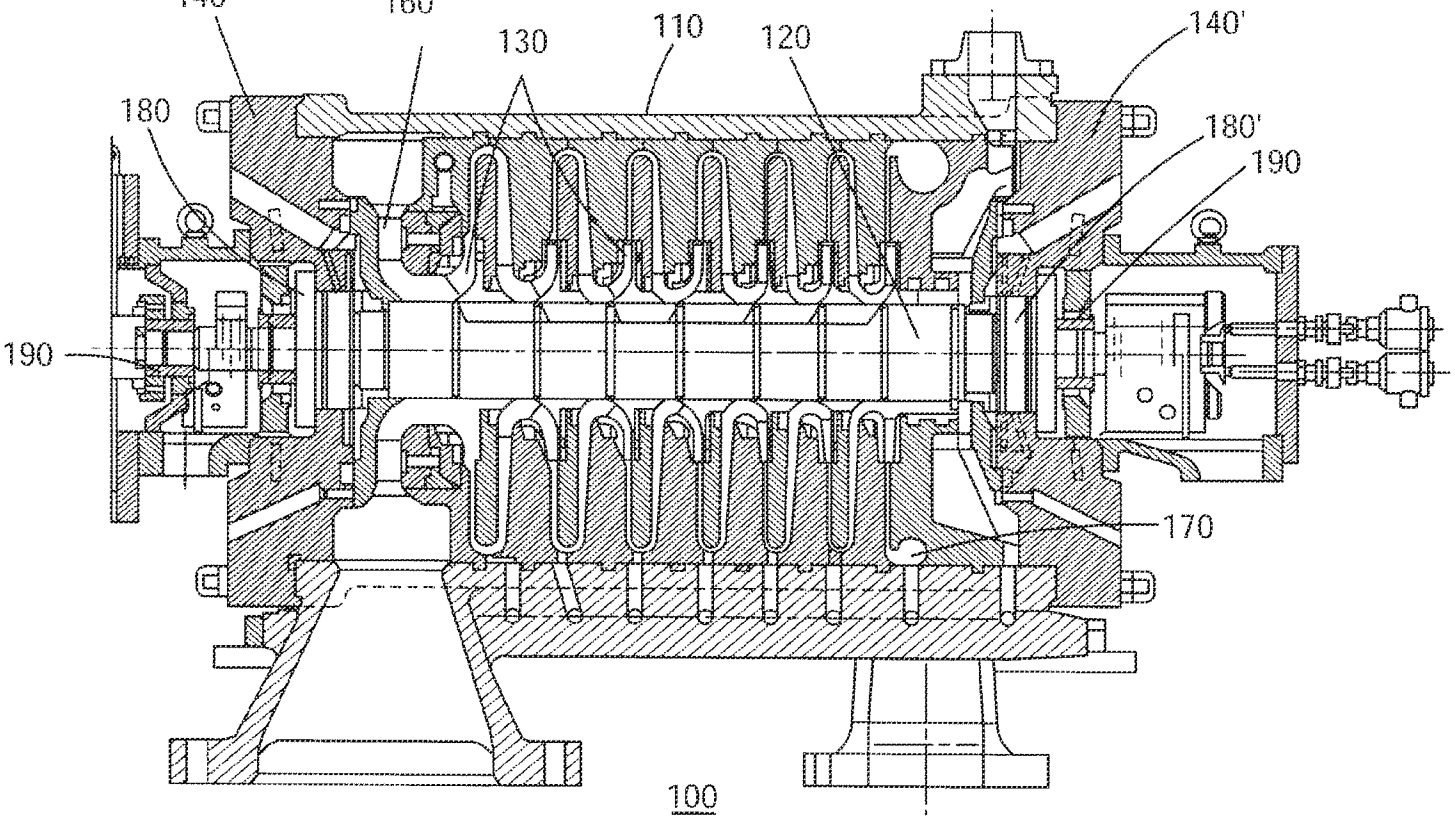
FIG. 1 Background Art
FIG. 1 illustrates a multistage compressor.

For BOG applications, the mechanical seal (such as sealings 180 and 180' of FIG. 1) may include a dry gas seal encapsulated in a heated seal carrier as is known. The dry gas seal closes the compressor to seal the compressor from the outside.

Figure 2:
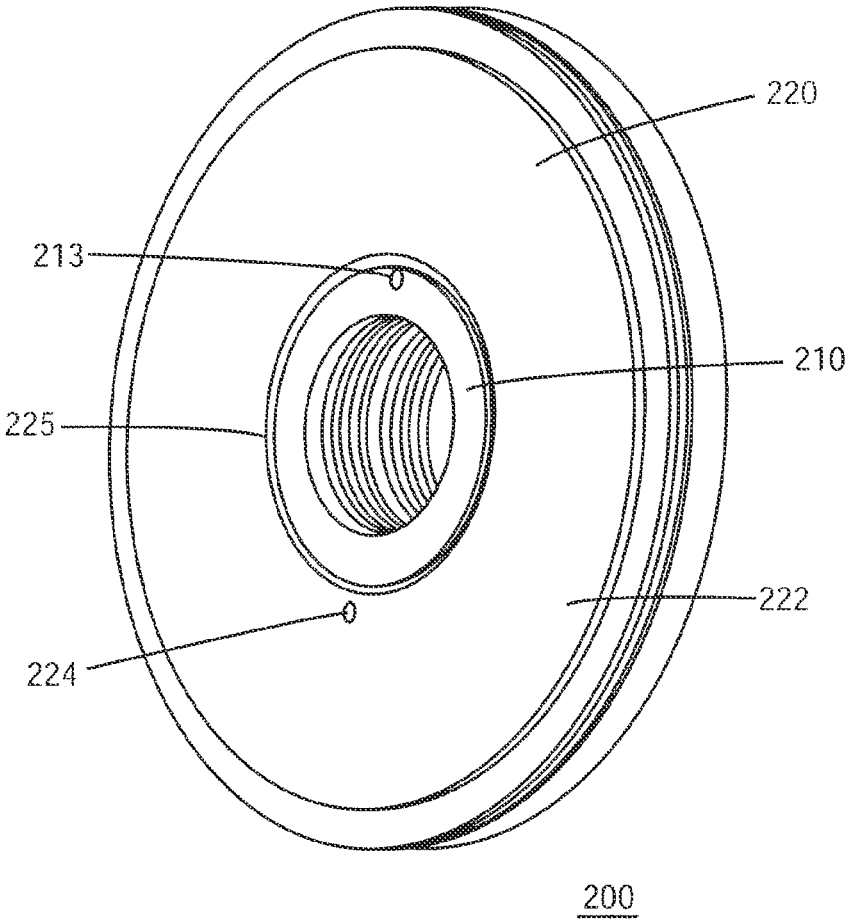
FIG. 2 illustrates a dry gas seal end head according to exemplary embodiments.

A dry gas seal may be in contact with an end head 140 and 140' at the end of the compressor. Referring to FIG. 2, end head 200 may includes an inner end head 210 and an outer end head 220. Each or both of the end heads 210 and 220 may be circular or may be some other shape but are illustrated as being circular in exemplary embodiments. End head 200 may be formed by, for example, welding the inner end head and outer end heads 210 and 220 in some embodiments.

Figure 6:
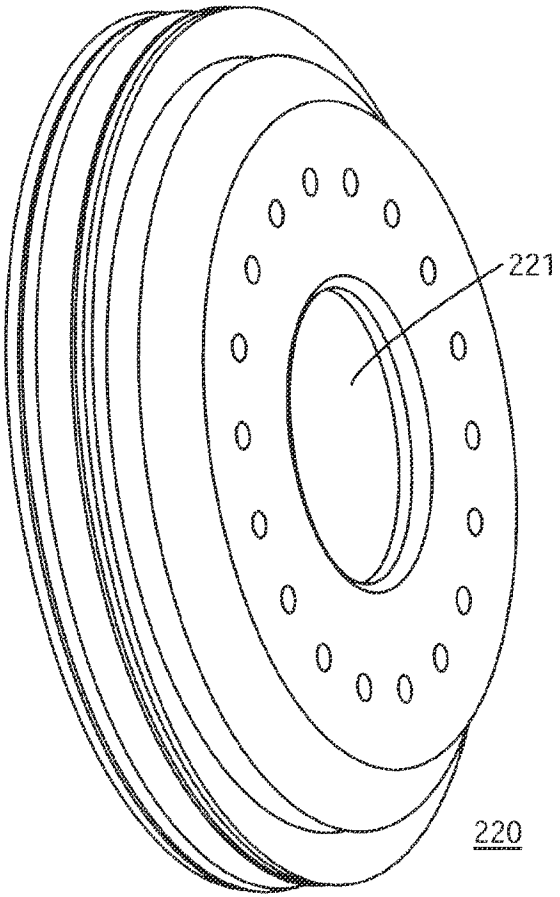
FIGS. 5 and 6 illustrate inner and outer sides of an outer end head according to exemplary embodiments.
Figure 5:
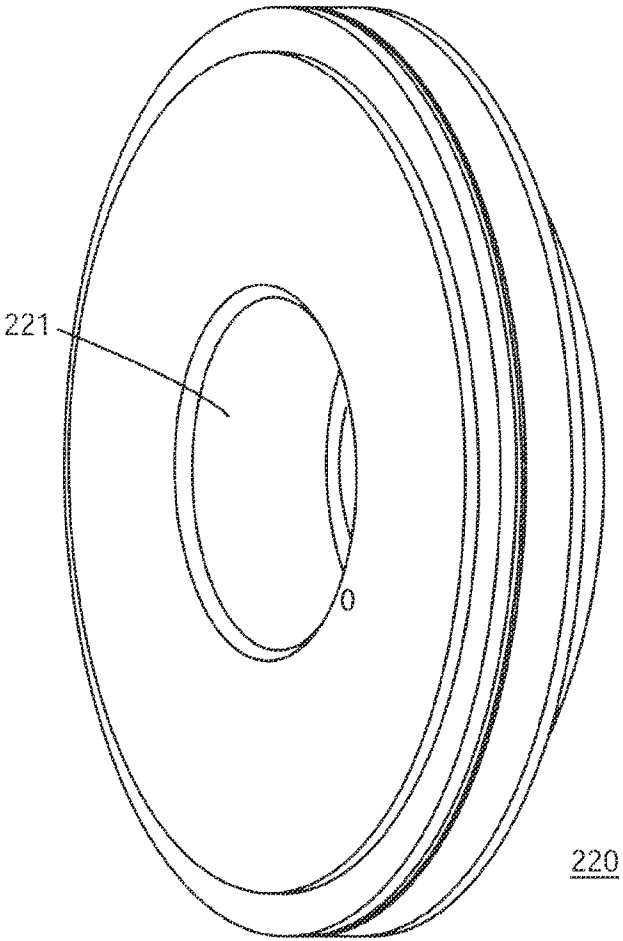

A circular or ring shaped outer end head 220 is illustrated in FIGS. 5 and 6. Outer end head 220 may include a circular opening 221 in the center within which inner end head 210 may be is circumferentially enclosed or fitted (as illustrated in FIG. 2).

Referring to FIG. 2, outer end head 220 includes a hot oil outlet 224 on an inner side surface 222. Outer end head 220 also includes a circular groove 225 surrounding the circular opening 221 where the inner end head 210 may be welded with the outer end head 220 to form the circumferential enclosure. Outer end head 220 may include grooves 225 along both side surfaces (i.e. inner side surface 222 and outer side surfaces) Inner end head 210 includes a hot oil inlet 213.

Figure 9:
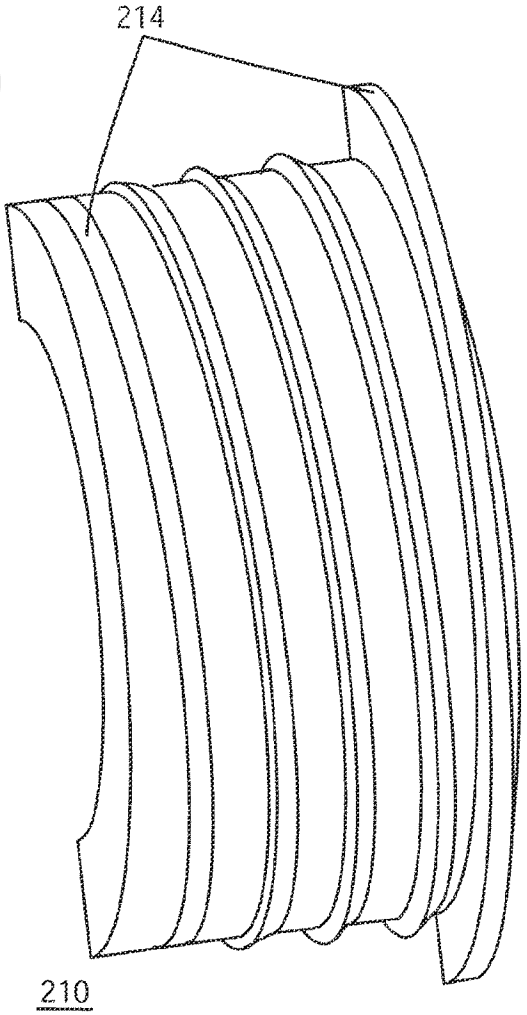
FIGS. 8 and 9 illustrate internal and external cut views of an inner end head according to exemplary embodiments.
Figure 8:
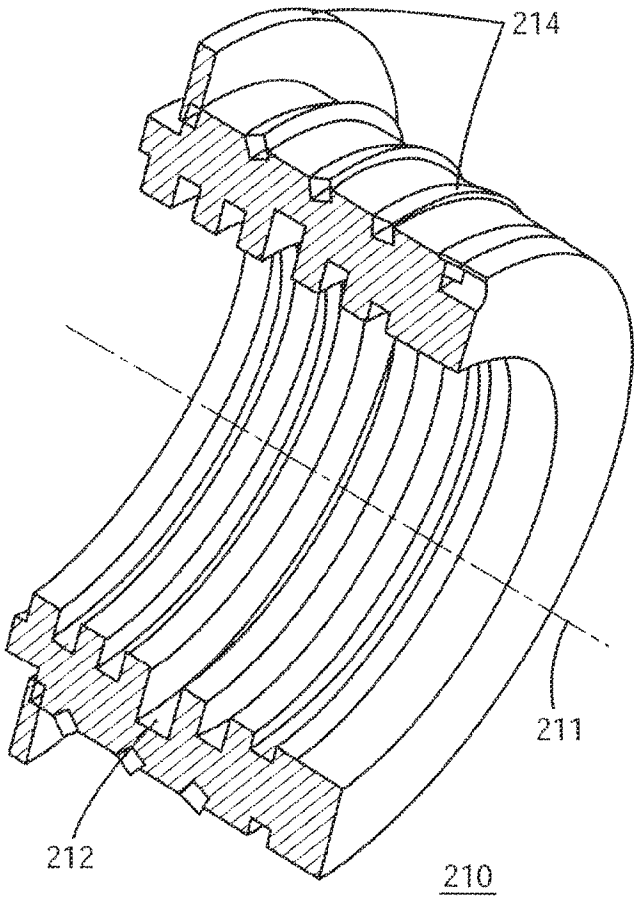

Cut section views of the outer and inner surfaces of inner end head 210 are illustrated in FIGS. 8 and 9. Inner end head 210 includes a circular opening 211 in the center. As illustrated in FIG. 8, inner end head 210 includes a plurality of grooves 212 within the opening for facilitating the placement and sealing of the end portion of a compressor shaft.

The diameter of inner end head 210 may be approximately equal to the diameter of circular opening 221 of outer end head 220 in order to facilitate the enclosure of inner end head 210 within outer end head 220.

As illustrated in FIG. 9, inner end head 210 may also includes an oil flow path 214 along an outer surface. Flow path 214 may be a helical flow path 214. Flow path 214 along the outer surface may be formed between the grooves 212 which are on the inner surface of inner end head 210. That is, the helical path 214 on the outer surface may correspond to the raised portion of the inner surface of the inner end head 210 between the grooves 212 (path 214 may be positioned on the outer surface corresponding to the raised portions between grooves 212 on the inner surface of the inner end head 210). In some embodiments, flow path 214 may correspond to the grooves 212. When the inner end head 210 is welded to outer end head 220, flow path 214 may provide a path for hot oil or gas to flow from inlet 213 to outlet 224.

Figure 4:
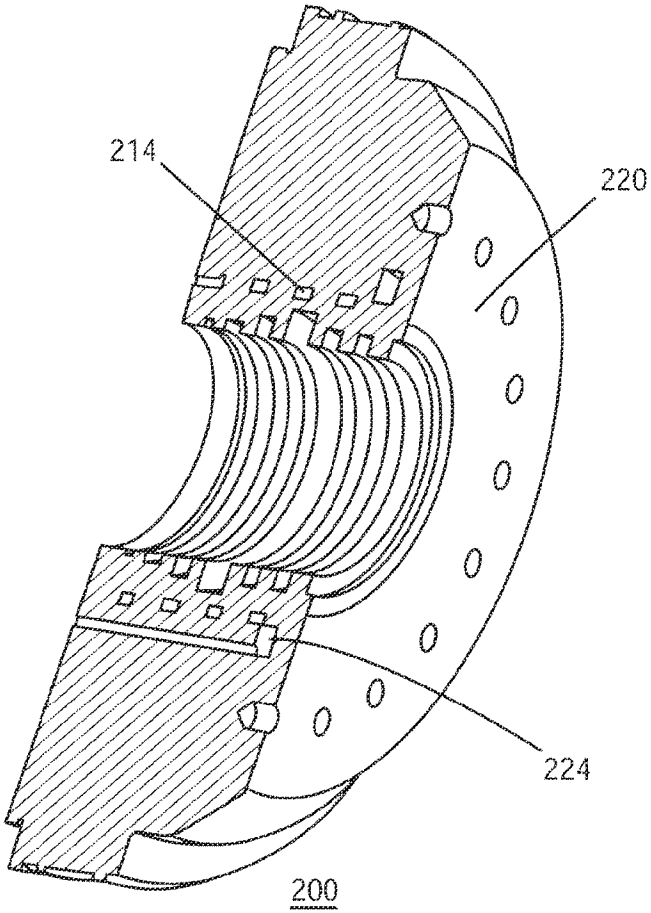
FIGS. 3 and 4 illustrate a cut view of a dry gas seal end head according to exemplary embodiments.
Figure 3:
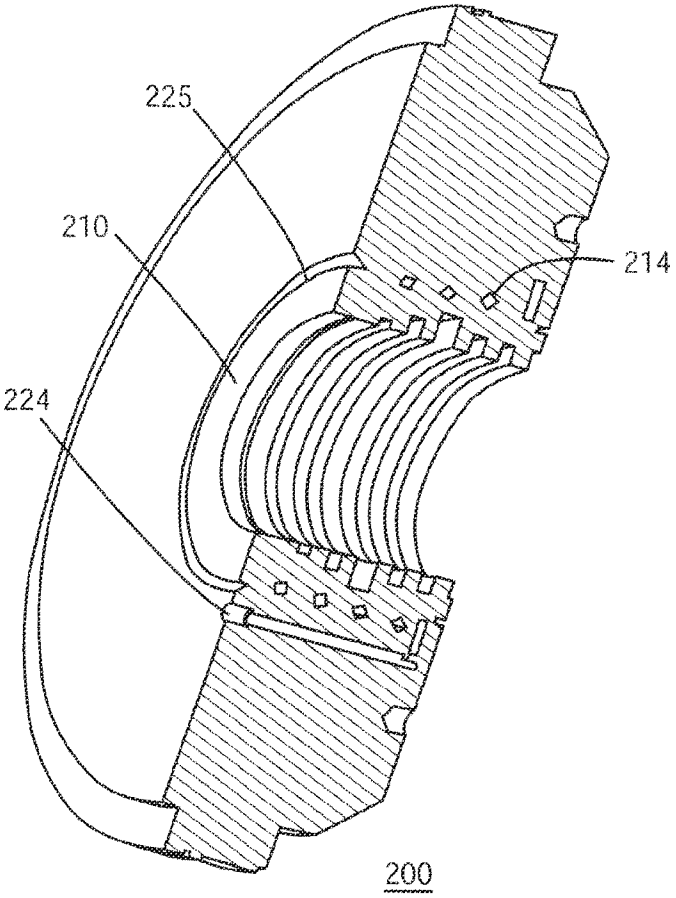

End head 200 of FIGS. 3 and 4 illustrates a helical flow path 214 and hot oil or gas outlet 224. When viewed in conjunction with FIG. 2, hot oil or gas entering inlet 213 of inner end head 210 flows through helical flow path 214 to outlet 224 of outer end head 220.

Figure 11:
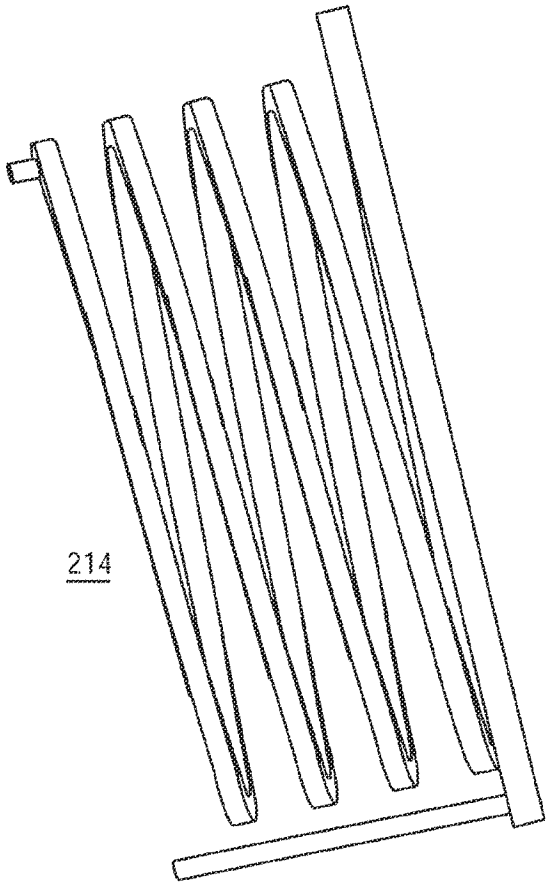
FIG. 11 illustrates an oil flow path in an end head according to exemplary embodiments.
Figure 10:
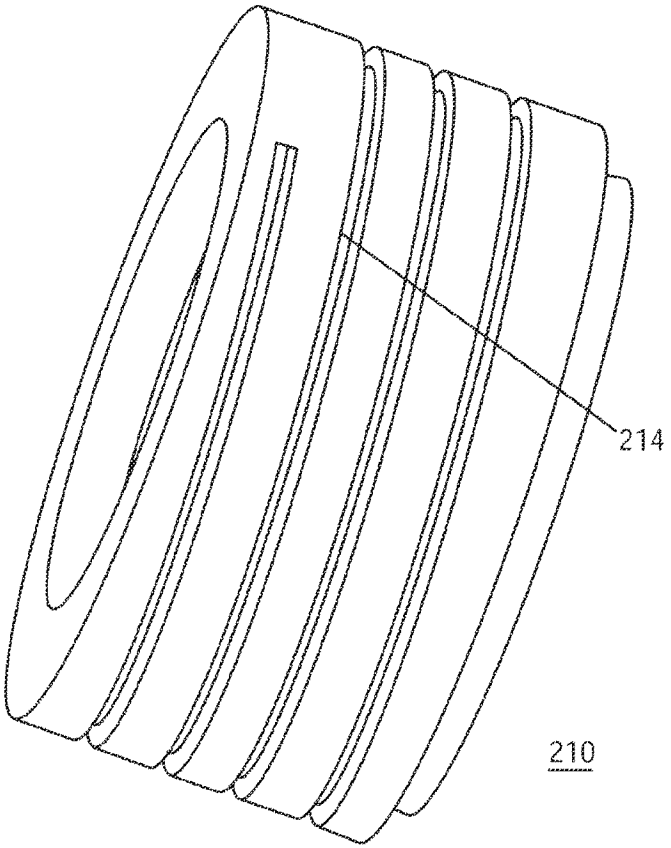
FIG. 10 illustrates an oil flow path in an inner end head according to exemplary embodiments.

The outer surface of inner end head 210 may include the helical flow path 214 as described above and illustrated in FIG. 10. The flow path 214 may be similar to a spiral path providing an axial thermal barrier as illustrated in FIG. 11. The flow path 214 as described herein provides a thermal barrier between the end head 210 and the DGS.

Figure 7:
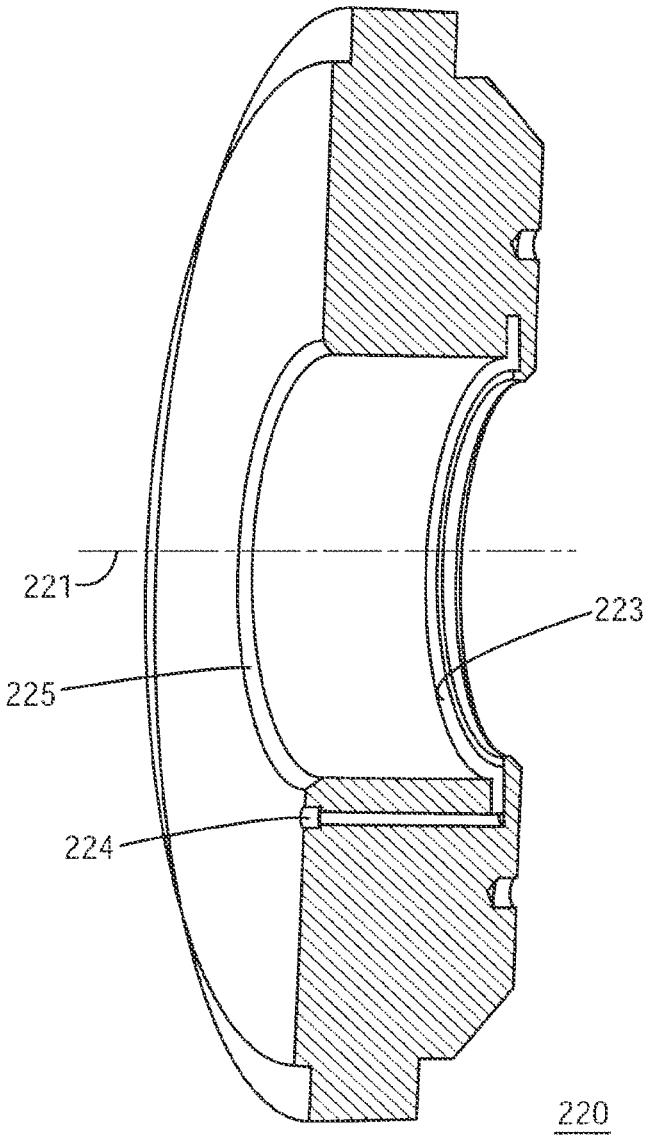
FIG. 7 illustrates a cut view of an outer end head according to exemplary embodiments.

In some embodiments, an additional thermal barrier may also be provided. Referring to FIG. 7, a hot oil/gas chamber 223 proximate the outer side surface of outer end head 220 (nearer to the DGS) reduces the thermal differential further. In this embodiment, oil in helical flow path 214 flows into chamber 223 and to outlet 224.

In order to prevent leakage from the helical flow path 214, a light interference fit may be made between the inner end head 210 and the outer end head 220 in some embodiments. The inner end head 210 and the outer end head 220 can also be bolted to the compressor housing in some embodiments.

In some embodiments, the helical flow path 214 may be substituted with straight holes in the outer end head 220 to provide heating to the inner end head 210 so that inner end head 210 and the dry gas seal can be maintained at required temperature to avoid interference between the dry gas seal and the inner end head 210 when the compressor handles or processes gas at cryogenic temperatures.

Figure 13:
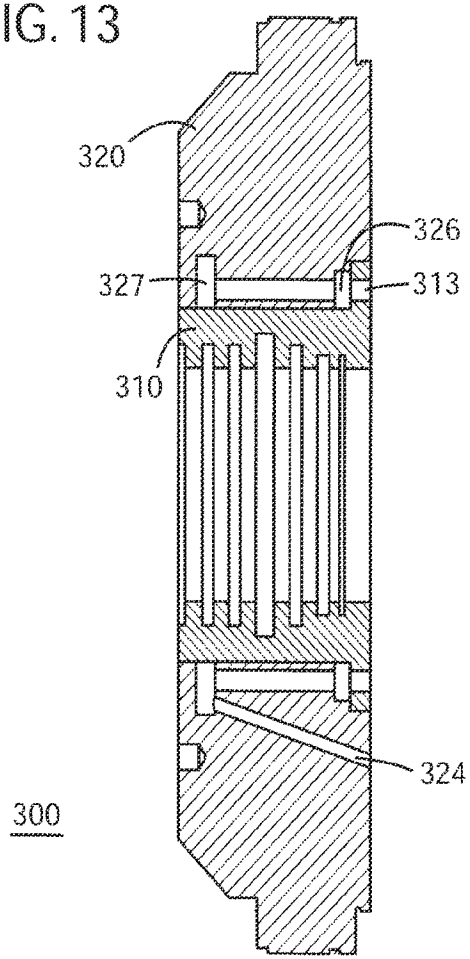
FIGS. 12 and 13 illustrate a cut view of a dry gas seal end head according to exemplary embodiments.
Figure 12:
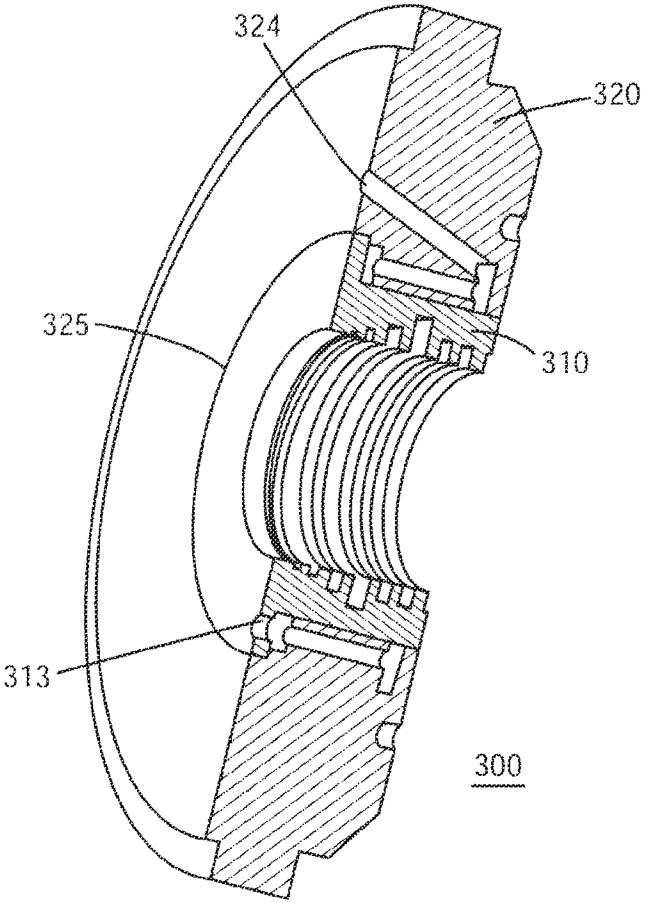

Referring to FIGS. 12 and 13, an end head 300 includes inner end head 310 and outer end head 320 (corresponding to inner end head 210 and outer end head 220 of end head 200 as described above). Inner end head 310 includes a hot oil inlet 313. Outer end head 320 includes hot oil outlet 324 and groove 325 for facilitating welding of inner end head 310 to outer end head 320. Outer end head 320 also includes an inlet gas or oil chamber 326 and an outlet gas or oil chamber 327.

Figure 14:
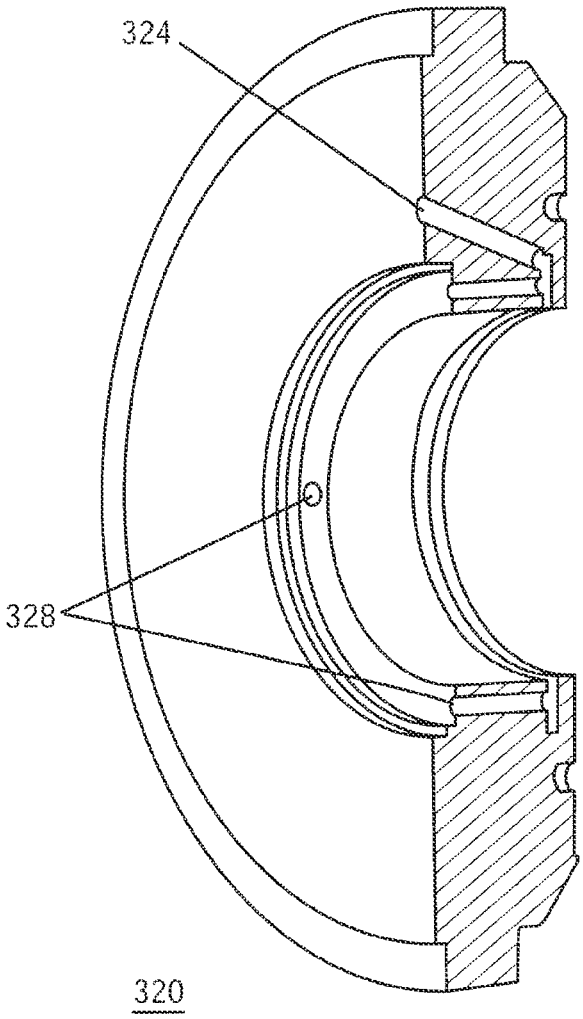
FIG. 14 illustrates a cut view of an outer end head according to exemplary embodiments.

Chamber 326 is provided near the inner head hot oil inlet 313 for receiving the oil from inlet 313. A plurality of passages 328 in the outer end head 320 (illustrated in FIG. 14) facilitates oil flow from inlet chamber 326 to outlet chamber 327. Outlet chamber 327 is connected to oil outlet 324. In exemplary embodiments, there may be four passages (or channels or holes) 328.

Chambers 326 and 327 may be connected with each other through straight holes 328 in outer end head 320 in order to facilitate uniform hot oil flow along the axis of the inner end head 310.

Figure 16:
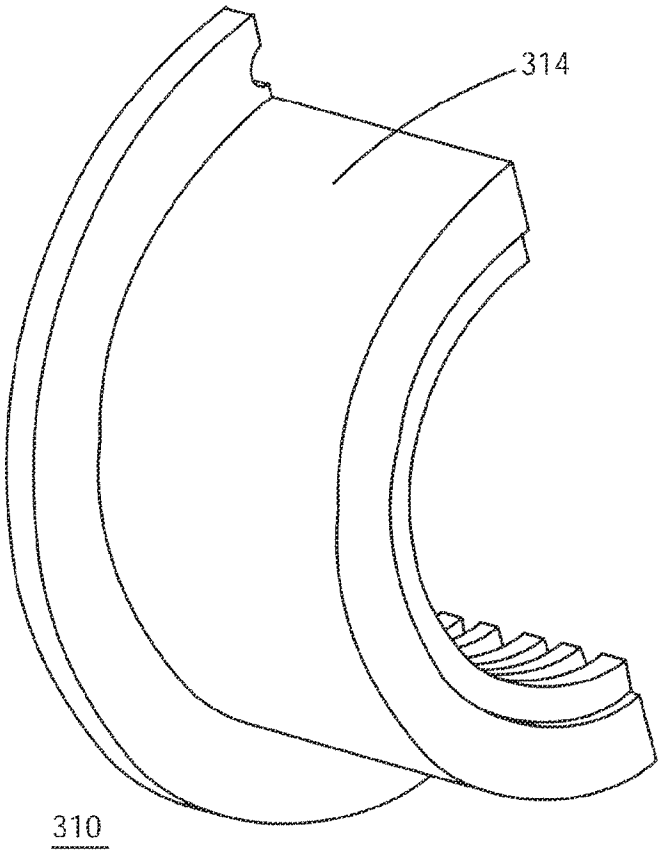
FIGS. 15 and 16 illustrate a cut view of an inner end head according to exemplary embodiments.
Figure 15:
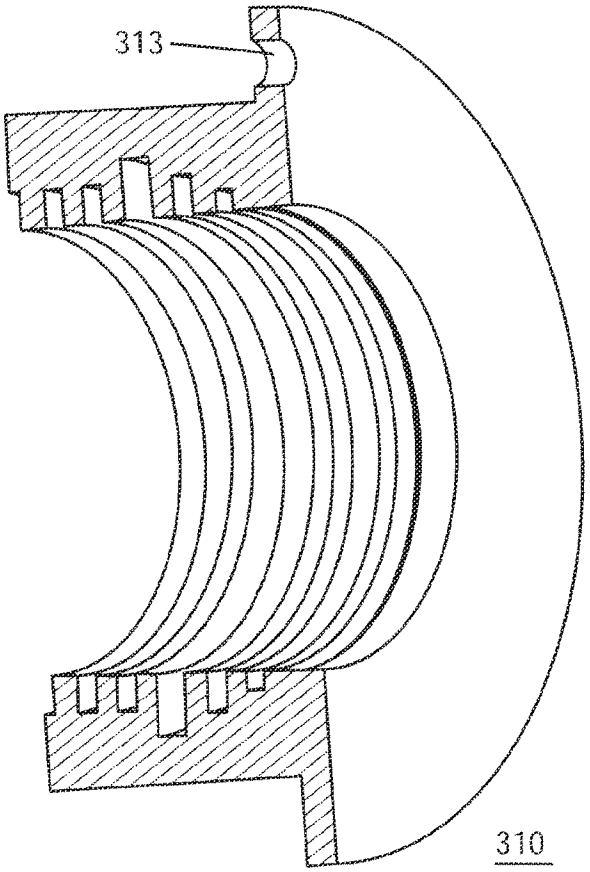

Inner end head 310 may be in the form as illustrated in FIGS. 15 and 16. Inner end head 310 may also facilitate oil flow along its outer surface 315 from inlet 313 to outlet 324 of outer end head 320. Inner end head 310 may provide a labyrinth seal.

The term inner side surface of an outer end head (or the inner end head) as used herein may refer to the side of the end head that is facing an impeller (i.e. between an impeller and end of the shaft). The term outer side surface as used herein may refer to the side of the end head that is on a side not facing an impeller (i.e. side of the end head that faces toward the outside of the casing).

The outer surface of the outer end head is adjacent the mechanical seal. The mechanical seal may be a dry gas seal (DGS). The inlet, the outlet, the chamber (of FIG. 7) and the flow path may be for hot oil or gas.

The inlet chamber 326 and the outlet chamber 327 provide a radial thermal barrier. Channels or passages 328 (of FIG. 12) may be axial channels and provide an axial thermal barrier.

Exemplary embodiments as described herein provide multiple advantages. A heating system according to exemplary embodiments provides a radial and axial thermal barrier. The thermal barrier reduces heat transfer between inlet and the zone surrounding the DGS leading to a smooth operation of the BOG compressor. The optimized flow path provides gradual change in temperature in radial and axial directions around the DGS and also reduces internal thermal stress. In addition, the heating system according to exemplary embodiments prevents interference between DGS and the end head. The system is simple and compact. The system also prevents interference and provides smooth operation of the BOG compressor at cryogenic temperatures.

Exemplary embodiments as described provide an axial thermal barrier or an axial and a radial thermal barrier for handling temperature gradients in boiled off gas applications. The end head may be bolted to the compressor. The inner and outer heads may also be interference fitted to form the end head.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

What is claimed is:

1. A compressor end head for providing a thermal barrier to a mechanical seal, the end head comprising:

an inner end head having an inner end head opening in a center of the inner end head, an inlet and inner end head grooves in the inner end head opening configured to place and seal an end portion of a compressor shaft; and an outer end head having an outer end head opening in a center of the outer end head, wherein the outer head end opening is configured to enclose the inner end head, an outlet, outer end head grooves alongside surfaces radially adjacent the outer head end opening, an inlet chamber connected to the inlet, an outlet chamber connected to the outlet and straight axial channels connecting the inlet chamber and the outlet chamber.

2. The compressor end head of claim 1, wherein the mechanical seal is a dry gas seal (DGS).

3. The compressor end head of claim 1, wherein an interference fit is made between the inner end head and the outer end head.

4. The compressor end head of claim 1, wherein at least a portion of a flow path of the outer end head corresponds to the inner end head grooves on an inner surface of the inner end head.

5. The compressor end head of claim 4, wherein the inlet, the outlet, the flow path, the inlet chamber, and the outlet chamber are for at least a flow of hot oil or gas.

6. The compressor end head of claim 4, wherein the flow path is connected to the inlet and the outlet.

7. The compressor end head of claim 4, wherein the flow path provides at least an axial thermal barrier to the mechanical seal.

8. The compressor end head of claim 4, wherein the flow path provides a radial thermal barrier to the mechanical seal.

9. The compressor end head of claim 1, wherein the inner end head is welded to the outer end head along the grooves of the outer end head.

10. The compressor end head of claim 1, wherein the inlet chamber is connected to the inlet of the inner end head and the outlet chamber is connected to the outlet.

11. The compressor end head of claim 1, wherein a heating substance flows from the inlet to the inlet chamber and from the inlet chamber to the outlet chamber through at least one of the straight axial channels.

12. A compressor comprising:

a shaft;

a plurality of impellers;

an inner end head having an inner end head opening in a center of the inner head end, an inlet, a plurality of inner end head grooves along a surface adjacent the inner end head opening configured to place and seal an end portion of the shaft; and an outer end head having an outer end head opening in a center of the outer end head, wherein the outer end head opening is configured to enclose the inner end head, an outlet, outer end head grooves radially adjacent the outer end head opening, an inlet chamber connected to the inlet, an outlet chamber connected to the outlet and straight axial channels connecting the inlet chamber and the outlet chamber.

* * * * *